US005362340A

United States Patent [19]

Daly et al.

[11] Patent Number: 5,362,340

[45] Date of Patent: Nov. 8, 1994

[54] METHOD OF PRODUCING ALUMINUM CAN SHEET HAVING LOW EARING CHARACTERISTICS

[75] Inventors: Marilyn Daly, Allison Park; Scott L. Palmer, Apollo; Robert E. Sanders, Jr., New Kensington, all of Pa.; W. Bryan Steverson, Maryville; Lyndon Morgan, Knoxville, both of Tenn.

[73] Assignee: Aluminum Company of America, Pittsburgh, Pa.

[21] Appl. No.: 37,266

[22] Filed: Mar. 26, 1993

[51] Int. Cl.[5] ..... C22F 1/04

[52] U.S. Cl. ..... 148/691; 148/693; 148/698; 148/700; 148/437; 148/438; 148/439

[58] Field of Search ..... 148/693, 698, 437, 438, 148/439, 691, 700, 552

[56] References Cited

U.S. PATENT DOCUMENTS

| | | | |
|---|---|---|---|
| 3,318,738 | 5/1967 | Winter | 148/691 |
| 3,486,947 | 12/1969 | Pryor et al. | 148/692 |
| 3,802,931 | 4/1974 | Bylund | 148/437 |
| 4,260,419 | 4/1981 | Robertson | 420/534 |
| 4,269,632 | 5/1981 | Robertson et al. | 148/693 |
| 4,282,044 | 8/1981 | Robertson et al. | 148/523 |
| 4,284,437 | 8/1981 | Baba et al. | 148/692 |
| 4,412,870 | 11/1983 | Vernam et al. | 148/439 |
| 4,501,627 | 2/1985 | Althoff | 148/437 |
| 4,502,900 | 3/1985 | Althoff | 148/440 |
| 4,605,448 | 8/1986 | Baba et al. | 148/439 |
| 4,637,842 | 1/1987 | Jeffrey et al. | 148/415 |
| 4,645,544 | 2/1987 | Baba et al. | 148/415 |
| 4,707,195 | 11/1987 | Tsuchida et al. | 148/439 |
| 4,753,685 | 6/1988 | Usui et al. | 148/439 |
| 4,929,285 | 5/1990 | Zaidi | 148/437 |
| 5,104,459 | 4/1992 | Chen et al. | 148/552 |
| 5,110,371 | 5/1992 | Moriyama et al. | 148/691 |

FOREIGN PATENT DOCUMENTS

| | | |
|---|---|---|
| 0121620 | 10/1984 | European Pat. Off. . |
| 0282162 | 9/1988 | European Pat. Off. . |
| 54-066313 | 5/1979 | Japan . |
| 57-149459 | 9/1982 | Japan . |
| 57-057551 | 12/1982 | Japan . |
| 58-126967 | 7/1983 | Japan . |
| 61-007465 | 3/1986 | Japan . |
| 61-019705 | 5/1986 | Japan . |
| 61-060143 | 12/1986 | Japan . |
| 61-288055 | 12/1986 | Japan . |
| 61-288056 | 12/1986 | Japan . |
| 62-001467 | 1/1987 | Japan . |
| 62-003231 | 1/1987 | Japan . |
| 62-006740 | 2/1987 | Japan . |
| 62-013421 | 3/1987 | Japan . |
| 62-037705 | 8/1987 | Japan . |
| 62-263954 | 11/1987 | Japan . |
| 63-007354 | 1/1988 | Japan . |
| 63-028850 | 2/1988 | Japan . |
| 63-149349 | 6/1988 | Japan . |
| 63-282245 | 11/1988 | Japan . |
| 63-282246 | 11/1988 | Japan . |
| 64-009388 | 2/1989 | Japan . |
| 64-087740 | 3/1989 | Japan . |
| 1123054 | 5/1989 | Japan . |

OTHER PUBLICATIONS

Hutchinson et al. "Control of Microstructure and Earing Behavior in Aluminum Alloy 3004 Hot Bands" *Materials Science and Technology*, Nov. 1989 vol. 5, No. 11 (pp. 1113–1127).

*Primary Examiner*—Richard O. Dean
*Assistant Examiner*—Robert R. Koehler
*Attorney, Agent, or Firm*—David V. Radack; David W. Brownlee

[57] ABSTRACT

A method of producing aluminum can sheet having low earing characteristics. An aluminum alloy ingot is provided and is heated to a temperature between about 527° to 571° C. (980° to 1060° F.). After this, the ingot is hot rolled in a single-stand reversible hot mill to produce an intermediate gauge sheet. The intermediate gauge sheet is then cold rolled to produce a final gauge aluminum can sheet having low eating characteristics.

19 Claims, 1 Drawing Sheet

METHOD OF PRODUCING ALUMINUM CAN SHEET HAVING LOW EARING CHARACTERISTICS

BACKGROUND OF THE INVENTION

This invention relates to a method of producing aluminum can sheet having low earing characteristics.

In the formation of aluminum can sheet into cup-shaped articles, a characteristic known as "earing" occurs as a scalloped appearance around the top edge of the formed cup. The scallops, or ears as they are more commonly known, are formed during the deep drawing step in the fabrication of the cup and represent an undesirable feature of the article. In aluminum can body stock, the cup is subsequently ironed in multiple rings which can accentuate the scalloped ears. High earing, therefore, can create transport problems with the cup as well as insufficient trim after ironing, clipped ears, and trimmer jams, all of which are unacceptable in aluminum can manufacturing. Thus, it is desired to minimize eating in order to avoid these problems and to increase the quality of the cup. See U.S. Pat. No. 3,318,738, the disclosure of which is incorporated herein by reference.

Commercially acceptable low earing can sheet can be produced using a process involving a multiple-stand hot continuous mill facility. In this process, an aluminum alloy ingot is first processed through a hot reversible or breakdown mill and then is subsequently introduced into a series of 2–6 hot rolling stands, collectively referred to as a hot continuous mill. After this, the hot rolled sheet is cold rolled to produce the final thickness sheet.

The hot continuous mill, while effective in producing low earing characteristics in the aluminum can sheet, represents a major capital expenditure. In addition, this process requires extensive coordination of the individual roll stands within the continuous mill for successful fabrication. Thus, it would be desirable to eliminate the hot continuous mill in order to substantially reduce the capital expense for producing aluminum can sheet, but only if aluminum can sheet can be produced which has low eating characteristics.

It is known to produce aluminum can sheet by eliminating the hot continuous mill. The sheet produced, however, has high earing and that impairs commercial usefulness. This is because it is difficult to control temperature variations throughout the sheet length during each hot rolling pass in a single-stand reversible hot mill. The variations in temperature experienced can result in uncontrolled recrystallization during hot rolling on the single-stand reversible hot mill. As a result of the uncontrolled recrystallization, sheet produced in a single-stand reversible hot mill tends to develop a low cube texture upon annealing. The amount of cube texture that develops upon annealing influences the level of earing that will be exhibited by the final sheet. The low levels of cube texture that typically develop in a single-stand reversible hot mill with a standard preheat produce unacceptably high 45° earing at finish gauge.

Thus, there is a need for an improved method of producing aluminum can sheet that has commercially acceptable eating characteristics in a single-stand reversible hot mill.

SUMMARY OF THE INVENTION

The method of this invention has met the above-described need. The method of producing aluminum can sheet having low earing characteristics comprises providing an aluminum alloy ingot and heating the ingot to a temperature between about 527°to 571° C. (980° to 1060° F.). After this, the ingot is hot rolled in a single-stand reversible hot mill to produce an intermediate gauge sheet. The intermediate gauge sheet is then cold rolled to produce a final gauge aluminum can sheet having low earing characteristics.

BRIEF DESCRIPTION OF THE DRAWINGS

A full understanding of the invention can be gained from the following description of the preferred embodiment when read in conjunction with the accompanying drawing in which:

The sole Figure is a schematic drawing showing an embodiment of the invention wherein a single-stand mill is utilized.

DETAILED DESCRIPTION

Figure 1B:
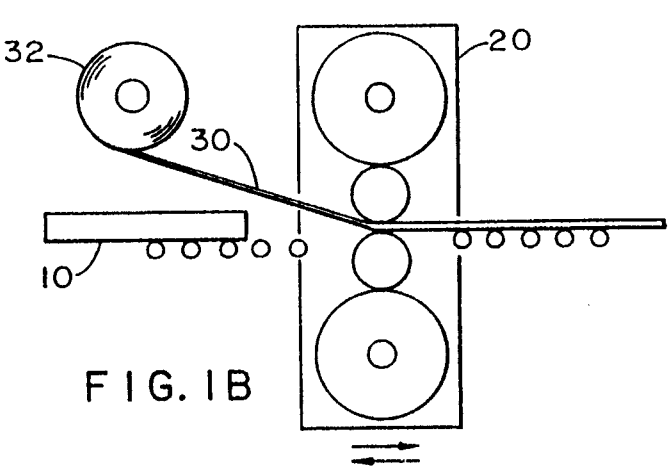
Figure 1D:
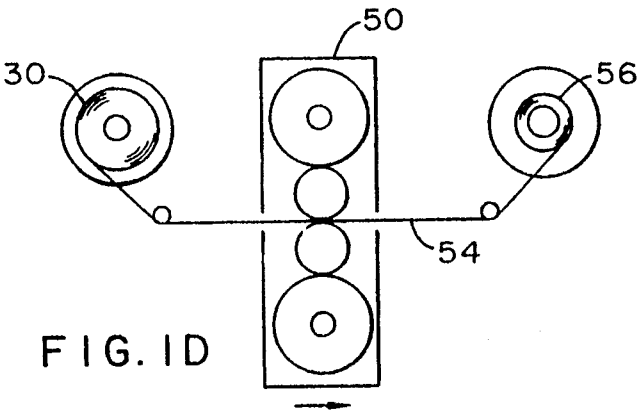
Figure 1A:
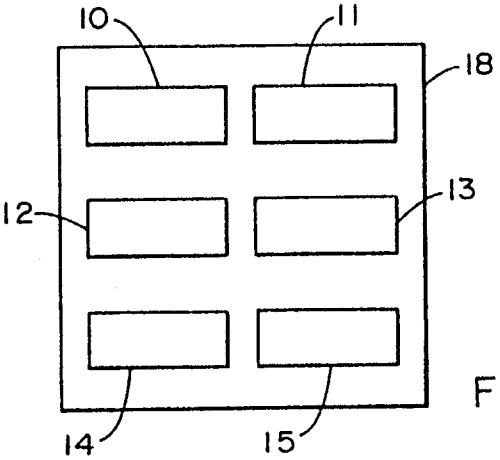
Figure 1C:
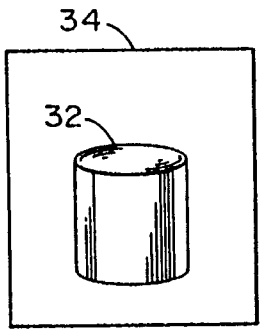

Referring now to the sole Figure, a schematic drawing illustrating an embodiment of the invention is shown. Six ingots, 10, 11, 12, 13, 14 and 15, are shown in a furnace 18, although it will be appreciated that the invention also contemplates utilizing furnaces of different sizes and configurations. The ingots 10–15 are composed of aluminum alloys which are suitable for making aluminum can sheet (including but not limited to aluminum can body stock) such as 3004 or 3104 (Aluminum Association designation) alloy containing about (in weight percent) 0.05–0.3% Si; 0.3–0.6% Fe; 0.7–1.25% Mn; 0.05–0.25% Cu; and 0.8–1.5% Mg, the balance substantially being aluminum and incidental elements and impurities. A preferred composition contains about 0.12 or 0.15% to 0.25% copper and about 1 or 1.1% to 1.3% magnesium or both.

Before being placed into furnace 18, the ingots 10–15 may have their surfaces machined or scalped to remove a portion of the metal thickness from each surface. This will remove surface defects from the ingots 10–15 which are created during the casting process. If the ingots 10–15 are not scalped at this point, they may be scalped after the furnace 18 heating step and before the hot rolling step.

The ingots 10–15 are heated in the furnace 18 in the following manner. The first step is a "heat-up" step wherein the ingots 10–15 are heated from room temperature to the soaking temperature of between about 527° to 571° C. (980° to 1060° F.) with 543° to 566° C. (1010° to 1050° F.) being preferred. The rate of heating during the heat-up step is approximately 10° to 66° C./hour (50° to 150° F./hour). The temperature of each of the ingots 10–15 is determined by known methods; in particular, by using thermocouples.

The ingots 10–15 are then maintained at the soaking temperature for about 1 to 8 hours. After this, the ingots 10–15 are cooled to the hot rolling temperature of about 496° to 538° C. (925° to 1000° F.). The rate of cooling from the soaking temperature to the hot rolling temperature is dependent on the furnace.

It is believed that the lower soaking temperature of the invention, in cooperation with the alloy composition, hot rolling temperature, exit thickness and other process control parameters, produces lower earing (less than 3.4%) than soaking temperatures known in the prior art by controlling the amount of recrystallization that occurs after each pass through the single-stand reversible hot mill. The mechanism for this is as follows.

Use of the lower temperature preheat produces a second phase dispersoid distribution that is both finer and denser than that produced by the higher preheat temperature of the prior art. The dense population of fine dispersoid particles pin the grain boundaries more effectively than the larger particles produced by the high temperature preheat of the prior art. The pinning of grain boundaries by the fine dispersoid particles inhibits the recrystallization that will occur between each pass through the single-stand reversible hot mill for the low temperature preheat.

Impeding and uniformly controlling recrystallization in the single-stand reversible hot rolling process is the key to the development of high cube texture in 3004 and 3104 alloys. It is the development of high cube texture in the hot mill coil prior to cold rolling that produces the lower earing achieved with the lower temperature preheat. This is achieved through the combination of alloy composition, preheat temperature and the hot rolling process which includes the deformation schedule, hot rolling temperature and exit thickness.

After the heating step, an ingot, for example ingot 10, is preferably promptly hot rolled in the single-stand reversible hot mill 20. The ingot 10 has a thickness of about 26.5 to 60.0 cm (10.4 to 23.6 inches) with about 51 cm (20 inches) being preferred. The ingot 10 is successively hot rolled on the single-stand reversible hot mill 20 to produce an intermediate gauge sheet 30 having a thickness of about 0.13 to 0.38 cm (0.050 to 0.150 inches), with about 0.20 cm (0.080 inches) being preferred. The intermediate gauge sheet 30 exits the single-stand reversible hot mill 20 at a temperature of about 249° to 405° C. (480° to 760° F.), with about 327° C. (620° F.) being preferred. The intermediate gauge sheet 30 is then wound onto a coil 32.

Preferably the hot mill schedule is such that recrystallization in the hot mill is minimized or reduced, at least as the hot line gauge becomes thinner than about 2.54 cm (1 inch) or 1.90 cm (0.75 inch) or 1.27 cm (0.5 inch). Rolling temperature percent reduction and delays between passes can be used to this end. Most preferably, all hot line recrystallization at gauges below 1.90 cm (0.75 inch) or 1.27 cm (0.5 inch) is avoided. This favors cube texture development in the metal when the hot line exit material later recrystallizes, such as during batch anneal or continuous anneal.

Especially, if the exit temperature of the intermediate gauge sheet 30 is lower than about 332° C. (630° F.), the coil 32 can be annealed in a furnace 34 at about 315° to 399° C. (600° to 750° F.) with about 360° C. (680° F.) being preferred and held at that temperature for about 1–12 hours, with about 2 hours being preferred, and then allowed to cool to room temperature. Optionally, if the exit temperature is higher than about 332° C. (630° F.), the coil 32 may "self-anneal" due to the residual heat of hot rolling and thus the annealing step set forth above may not be necessary.

After annealing, if any, the intermediate gauge sheet 30 is cold rolled through a cold mill 50 to the final thickness of about 0.023 to 0.033 cm (0.009 to 0.013 inches) and the final gauge sheet 54 is wound onto coil 56.

EXAMPLE

As an example of the application of the present invention, an aluminum melt was adjusted to have the concentration (in weight percent) of elements listed in Table 1.

TABLE 1

| Si | Fe | Cu | Mn | Mg |
|---|---|---|---|---|
| 0.22 | 0.40 | 0.17 | 1.02 | 1.24 |

The resulting alloy composition was cast by the direct chill method into five ingots approximately 48 cm (19 inches) thick.

Four of the ingots were subjected to the preheat of the present invention by heating them to a temperature of about 551° C. (1025° F.) and holding at this temperature for 4 hours. The remaining ingot was subjected to essentially the same procedure except that it was heated to a temperature of about 593° C. (1100° F.) and held at this temperature for 4 hours.

The broad surfaces of all five ingots were machined to remove some metal thickness from each surface. Following machining the ingots were placed in one furnace and reheated to a temperature of 510° C. (950° F.) and allowed to equilibrate at this temperature for about a two hour period. The ingots were then successively hot rolled on a single-stand reversible hot mill to a thickness of 0.2 cm (0.080 inch) and exited the rolling mill at temperatures from about 248° to 290° C. (480° F. to 570° F.). They were next batch annealed in coil form in a furnace at about 360° C. (680° F.) for a minimum of four hours and allowed to cool to room temperature.

Following annealing was a cold rolling step which reduced the metal thickness to about 0.03 cm (0.012 inch). Testing of resulting strip demonstrated the average earing values listed in Table 2. Earing values were determined by the common method of drawing a cup 40%. This means that the punch diameter was 40% smaller than the sheet circle diameter The earing value is expressed as the percent difference between the lowest and the highest heights of the drawn cup sidewall.

TABLE 2

| | 45° Earing | | |
|---|---|---|---|
| Preheat Temperature | Number of Tests | Average | Standard Deviation |
| 593° C. (1100° F.) | 18 | 4.45% | 0.26% |
| 551° C. (1025° F.) | 72 | 3.34% | 0.50% |

As can be seen, ingot that was subject to the low preheat temperature produced sheet exhibiting lower 45° earing than the sheet produced from ingot that was subject to a high preheat temperature. The low temperature preheat earing results meet current product requirements, whereas the high temperature preheat material is too high in earing to be commercially acceptable.

While the invention has been described in terms of preferred embodiments, the claims appended hereto are intended to encompass all embodiments which fall within the spirit of the invention.

What is claimed is:

1. A method of producing aluminum can sheet having low earing characteristics, said method comprising:

providing an aluminum alloy body;

heating said body to a soaking temperature of between about 527° to 571° C. (980° to 1060° F.);

hot rolling said body, said hot rolling consisting of hot rolling in a single-stand reversible hot mill to produce an intermediate gauge sheet, said intermediate gauge sheet exiting said single-stand reversible hot mill at a temperature between about 249° to 405° C. (408° to 760° F.); and cold rolling said intermediate gauge sheet to produce said aluminum can sheet having low earing characteristics.

2. The method of claim 1, wherein said aluminum alloy body is aluminum can body stock consisting essentially of about 0.05 to 0.3 wt. % Si, about 0.3 to 0.6 wt. % Fe, about 0.05 to 0.25 wt. % Cu, about 0.7 to 1.25 wt. % Mn and about 0.8 to 1.5 wt. % Mg, the balance substantially being aluminum and incidental elements and impurities.

3. The method of claim 1, wherein said aluminum alloy body is composed of 3004 aluminum alloy.

4. The method of claim 1, wherein said aluminum alloy body is composed of 3104 aluminum alloy.

5. The method of claim 1, wherein said body has a thickness of at least 26.5 cm (10.4 inches).

6. The method of claim 5, wherein said body has a thickness of between about 26 cm and 60 cm (10.2 to 23.6 inches).

7. The method of claim 1, wherein said soaking temperature is between about 543° to 566° C. (1010° to 1050° F.).

8. The method of claim 1, including maintaining said aluminum alloy body at said soaking temperature for about 1 to 8 hours.

9. The method of claim 1, including cooling said body from said soaking temperature to a hot rolling temperature of between about 496° to 538° C. (925° to 1000° F.).

10. The method of claim 1, including allowing said body to cool from said soaking temperature to about room temperature; and before hot rolling said body, heating said body to said hot rolling temperature.

11. The method of claim 1, including winding said intermediate gauge sheet onto a coil; and batch annealing said coil in a furnace.

12. The method of claim 1, wherein said intermediate gauge sheet has a thickness of between about 0.13 to 0.38 cm (0.05 to 0.15 inches).

13. The method of claim 1, wherein said intermediate gauge sheet exits said single-stand reversible hot mill at a temperature between about 249° to 405° C. (480° to 760° F.).

14. The method of claim 1, wherein said aluminum can sheet has a thickness of between about 0.023 to 0.033 cm (0.009 to 0.013 inches).

15. The method of claim 1, wherein said aluminum can sheet has 45° earing of about 3.4% or less.

16. The method of claim 15, wherein said aluminum can sheet has 45° earing of about 3.4% or less.

17. A method of producing aluminum can sheet having low earing characteristics, said method comprising:

providing an aluminum alloy body consisting essentially of about 0.05 to 0.3 wt. % Si, about 0.3 to 0.6 wt. % Fe, about 0.05 to 0.25 wt. % Cu, about 0.7 to 1.25 wt. % Mn and about 0.8 to 1.5 wt. % Mg, the balance substantially being aluminum and incidental elements and impurities;

heating said body to a soaking temperature of between about 527° to 571° C. (980° to 1060° F.) and holding said body at said soaking temperature for at least 1 hour;

hot rolling said body, said hot rolling consisting of hot rolling in a single-stand reversible hot mill to produce an intermediate gauge sheet having a thickness of between about 0.13 to 0.38 cm (0.05 to 0.15 inches), said intermediate gauge sheet exiting said single-stand reversible hot mill at a temperature between about 249° to 405° C. (480° to 760° F.); and cold rolling said intermediate gauge sheet to produce said aluminum can sheet having low earing characteristics.

18. The method of claim 17, wherein said body has a thickness of at least 26 cm (10.2 inches).

19. The method of claim 17, wherein said soaking temperature is between about 543° to 566° C. (1010° to 1050° .F).

* * * * *

UNITED STATES PATENT AND TRADEMARK OFFICE

CERTIFICATE OF CORRECTION

PATENT NO. : 5,362,340
DATED : November 8, 1994
INVENTOR(S) : Marilyn Daly et al.

It is certified that error appears in the above-indentified patent and that said Letters Patent is hereby corrected as shown below:

| | |
|---|---|
| In the Abstract<br>last line | Change "eating" to --earing--. |
| Col. 4, line 68<br>Claim 1 | Change "408°" to --480°--. |

Signed and Sealed this

Sixteenth Day of April, 1996

Bruce Lehman

*Attest:*

BRUCE LEHMAN

*Attesting Officer*

*Commissioner of Patents and Trademarks*